US009440236B2

(12) United States Patent
Macinnes et al.

(10) Patent No.: US 9,440,236 B2
(45) Date of Patent: Sep. 13, 2016

(54) METHOD AND DEVICE FOR OUTPUT OF MINERAL MATERIAL FROM A DRUM MILL

(75) Inventors: Don Macinnes, Ontario (CA); Sever Ciutina, High Wycombe (AU)

(73) Assignee: Metso Minerals (Sweden) AB, Ersmark (SE)

( * ) Notice: Subject to any disclaimer, the term of this patent is extended or adjusted under 35 U.S.C. 154(b) by 413 days.

(21) Appl. No.: 13/988,353

(22) PCT Filed: Nov. 29, 2011

(86) PCT No.: PCT/SE2011/051445

§ 371 (c)(1),
(2), (4) Date: Jun. 11, 2013

(87) PCT Pub. No.: WO2012/074474

PCT Pub. Date: Jun. 7, 2012

(65) Prior Publication Data

US 2014/0054401 A1 Feb. 27, 2014

(30) Foreign Application Priority Data

Nov. 29, 2010 (SE) ..... 1051250

(51) Int. Cl.
*B02C 17/18* (2006.01)

(52) U.S. Cl.
CPC ..... *B02C 17/1855* (2013.01); *B02C 17/1825* (2013.01); *B02C 17/1845* (2013.01)

(58) Field of Classification Search
CPC ..... B02C 17/18; B02C 17/1855; B02C 17/1825; B02C 17/1845
USPC ..... 241/24.1, 70
See application file for complete search history.

(56) References Cited

U.S. PATENT DOCUMENTS 3,231,203 A 1/1966 Hardinge et al.
8,128,014 B2 * 3/2012 Allenius ..... B02C 17/1855 241/291
2010/0314475 A1 12/2010 Allenius et al.

FOREIGN PATENT DOCUMENTS

WO 2006134200 A1 12/2006
WO 2010012105 A1 2/2010

OTHER PUBLICATIONS

International Search Report from PCT/SE2011/051445 mailed Mar. 7, 2012.

* cited by examiner

*Primary Examiner* — Mark Rosenbaum
(74) *Attorney, Agent, or Firm* — Andrus Intellectual Property Law, LLP

(57) ABSTRACT

The invention concerns a method and an arrangement for the output of mineral material from a drum mill having a horizontal rotation axis, a sieving wall at its end wall, material can leave through the sieving openings in to pulp-lifting chambers, limited by the sieving wall, the end wall, a limiting wall, and limiting walls that lead towards an output cone, whereby material in the pulp-lifting chamber is emptied down towards the output cone when the pulp-lifting chamber is an upper part of a revolution. In order to increase the rate of revolution, material that does not reach the material output cone is collected in a material collection pocket which carry the material at a level radially closer to the rotation axis than the inner limiting wall, whereby collected mineral material leaves the material collection pocket during, a subsequent revolution.

11 Claims, 4 Drawing Sheets

METHOD AND DEVICE FOR OUTPUT OF MINERAL MATERIAL FROM A DRUM MILL

CROSS-REFERENCE TO RELATED APPLICATIONS

Figure 1:
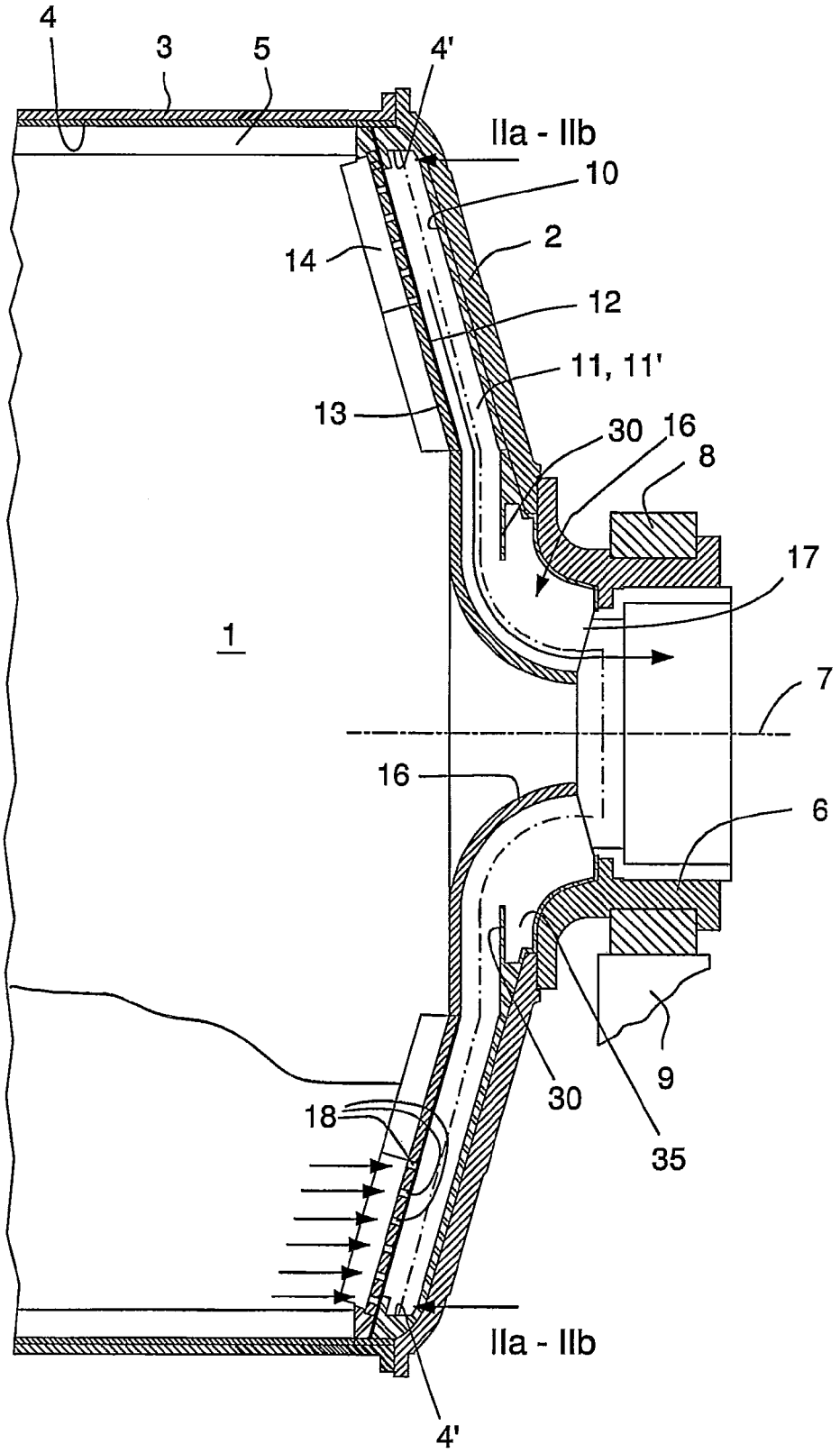

This application claims priority to PCT/SE2011/051445, filed Nov. 29, 2011, and published in English on Jun. 7, 2012 as publication number WO 2012/074474, which claims priority to SE Application. No 1051250-7, filed Nov. 29, 2010, incorporated herein by reference.

The present invention concerns a method for the output of mineral material from a rotating drum mill for autogenous or semi-autogenous wet grinding according to the introduction to claim 1. The invention concerns also a device for the execution of the method according to the introduction to claim 8.

At a rotating drum mill, material in the form of crushed ore is fed into one end of the mill, the input end wall, and milled ore is extracted through a centrally placed material-output tap at the second end of the mill, the output end wall. Water is supplied during the milling such that finely divided ore particles and water form a pulp or slurry. A large, principally circularly cylindrical compartment is located between the input end wall and the output end wall, generally known as the mill chamber. In association with the output end wall, there is a surrounding cone-shaped output chamber for the output of milled pulp from the mill chamber, whereby the said output chamber is limited by a sieving wall located inside the grinding space of the mill. The milled pulp in the mill chamber is lifted or promoted to the material output tap by means of a number of pulplifters having the form of buckets and radially directed towards the rotation axis, which pulplifters rotate with the mill. For the formation of the pulplifters, the principally circular sieving wall is provided with a number of radially set limiting walls or carriers, evenly distributed around the rotation axis, which carriers limit, together with the output end wall, a number of compartments having the form of a sector of a circle, known as pulp-lifting chambers. The said pulp-lifting chambers become more narrow in the direction towards the centre of rotation in a material output cone that extends into the output tap. During the rotation of the mill, pulp of finely milled mineral material is led through openings in the sieving wall in to the said pulp-lifting chambers when they are located at a lower position of the rotation, and when promoted to an upper position of the rotation the mineral material falls down towards the material output cone in the centre of the output end wall of the mill, whereby the cone serves as direction control, or deflector, for directing the material out of the mill. The pulp-lifting chambers thus form a number of output channels whose task it is to lead the mineral-containing pulp out from the milling compartment of the mill during the rotation of the mill.

One problem with known output arrangements is that the milled ore, when it is emptied from the pulplifters from the upper position, and when the ore is intended to fall under the influence of gravity essentially "freely down towards the material output cone", the complete quantity of ore particles does not have sufficient time to leave the relevant pulp-lifting chamber and carrier, but falls back into the pulplifter and accompanies this as it continues its rotation. This problem, naturally, has a negative effect of the capacity of the output arrangement and it means, furthermore, unnecessary wear of this arrangement, through the undesired recirculation of the ore material in the output arrangement.

One method to avoid the problem with mineral material falling back into the output arrangement is, obviously, to drive the mill at a reduced rate of rotation, to rotate the mill at, for example, 50-70% of the critical speed. The term "100% of the critical speed" is used to denote a rate of rotation that is sufficiently high such that no material leaves the mill, and all mineral material is driven out towards the inner surface of the limiting wall of the pulplifter, located at the outermost radial location and facing in towards the rotation axis, through the influence of centrifugal forces that arise. The disadvantage of using the mill at a reduced speed is, of course, that the milling capacity decreases to unacceptable levels. This type of mill is usually driven at approximately 70-80% of the critical speed, which leads to an optimal balance for obtaining the highest possible milling efficiency.

A second problem with a portion of the milled ore not leaving the mill and travelling back into the output arrangement is that the ore material that remains in place or returns reduces the degree of filling of the output arrangement. The reason for this is that the mineral material that falls back limits the total amount of space available for receiving new slurry from the mill chamber when the rotating pulp-lifting chamber of the output arrangement is located at the lowest point of the mill during its rotation.

A third problem is that remaining milled ore material that travels back into the output arrangement contributes to an increased and particularly unnecessary wear on the output arrangement.

The aim of the present invention, therefore, is to achieve a method during the output of mineral material from a rotating drum mill of the type described above that solves the problems described and that makes it possible to increase the milling speed and capacity of the mill by driving the mill at its highest possible speed. A second aim of the invention is to achieve an arrangement for the execution of the method.

This aim is achieved through a method that demonstrates the distinctive features and characteristics that are specified in claim 1, and an arrangement that demonstrates the distinctive features and characteristics that are specified in claim 8. Further characteristics and advantages of the invention are made clear by the non-independent claims.

Figure 2A:
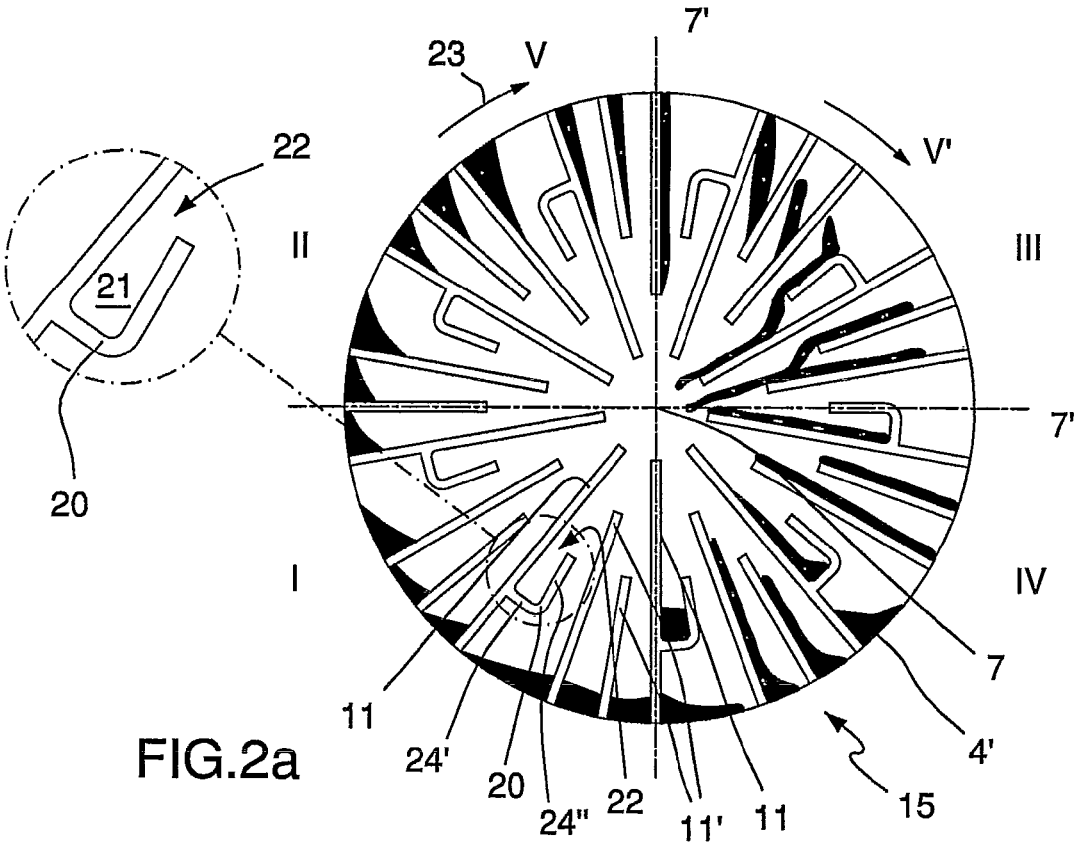
Figure 2B:
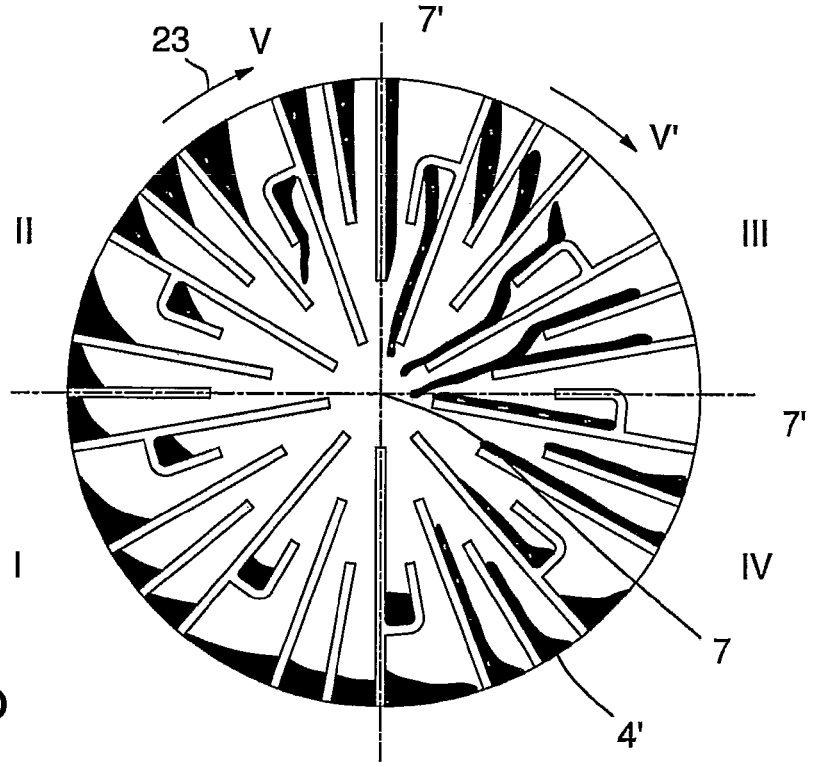

The present invention will be described below in more detail with reference to the attached drawings, of which:

FIG. 1 shows an axial section of a part of the output end of a mill with an arrangement for the output of milled ore material according to the present invention in a basic design, with pulp-lifting chambers that have the nature of sectors of a circle and are evenly distributed around a periphery, FIG. 2*a* shows in a cross-sectional view the output end of the rotating mill viewed along the line IIa,b-IIa,b in FIG. 1, and showing—based on a computer-based simulated operation—how the mineral material that is located in the various pulp-lifting chambers of the output arrangement is redistributed during a first revolution, FIG. 2*b* shows in a cross-section the output end of the mill corresponding to FIG. 2*a* and showing how the mineral material that is located in the various pulp-lifting chambers of the output arrangement is redistributed during the rotation when the mill rotates in a stationary condition.

Figure 3:
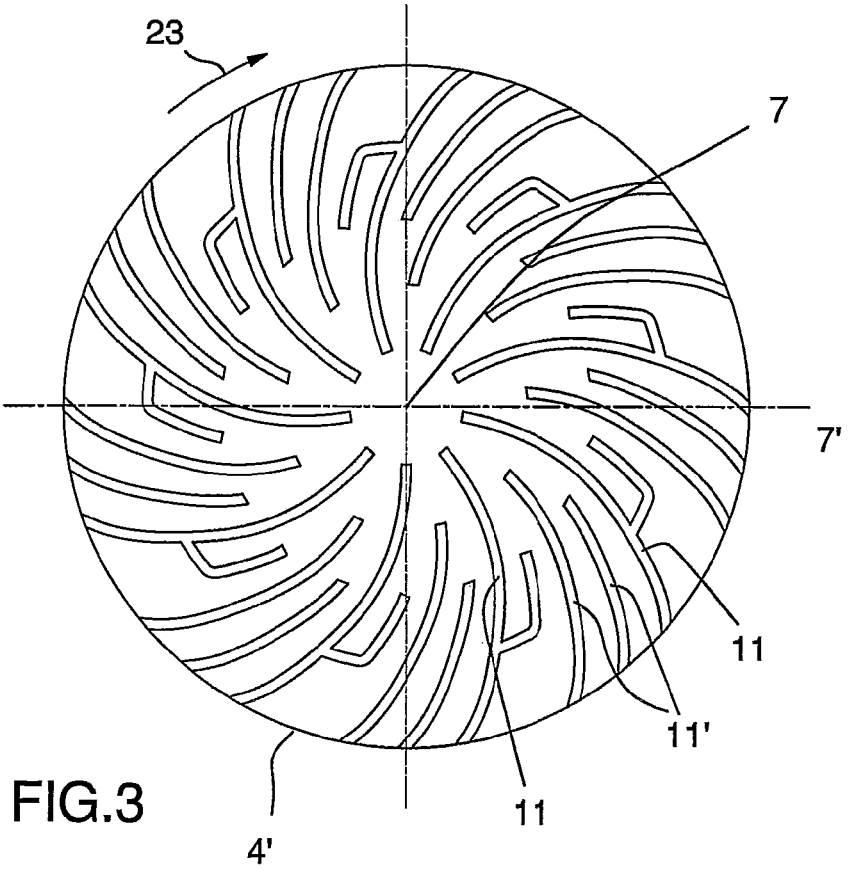
Figure 4:
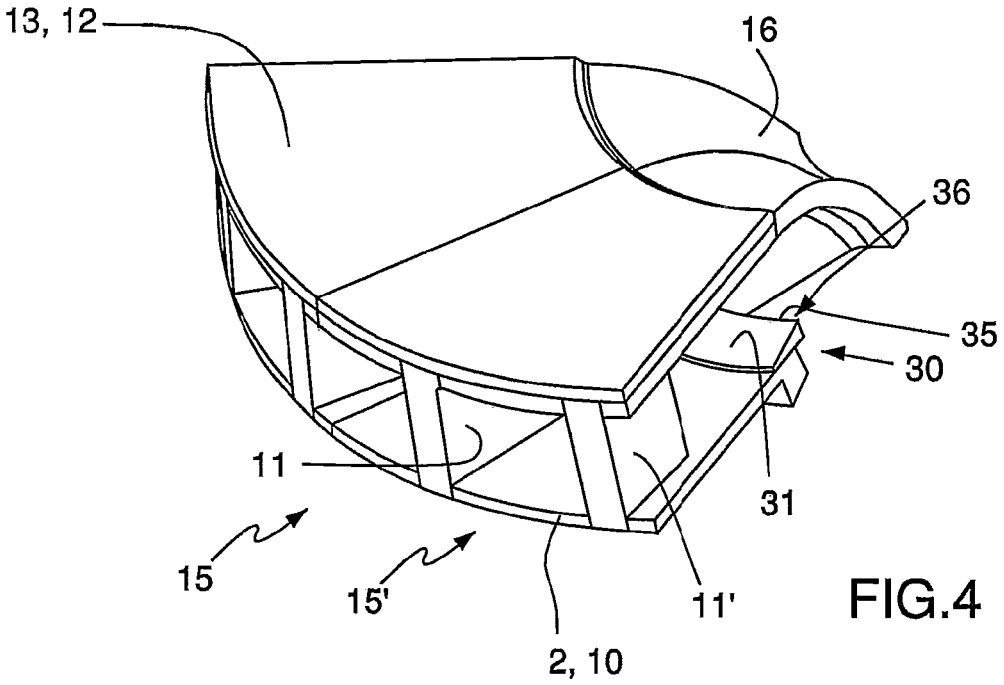
Figure 5:
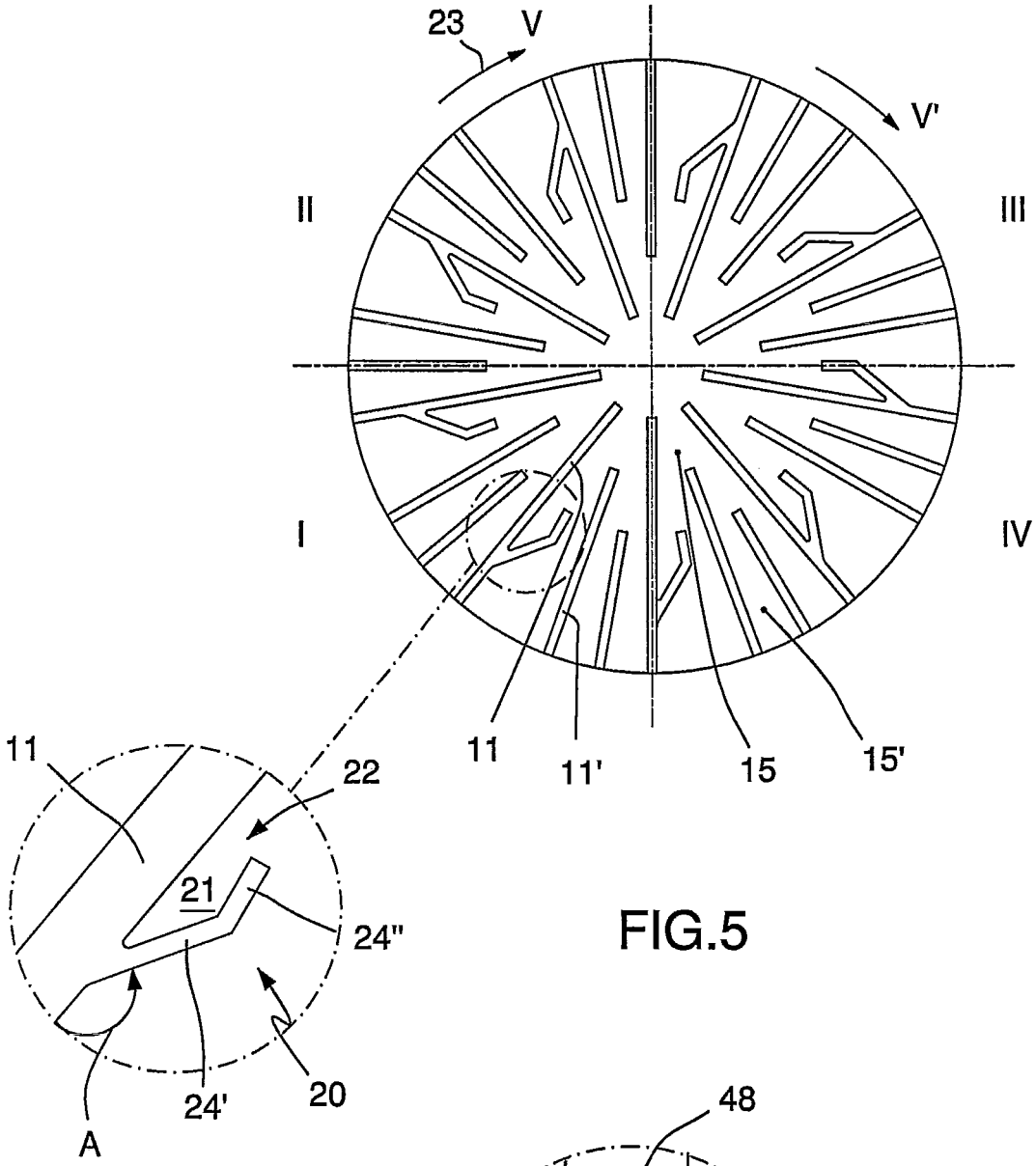
Figure 6:
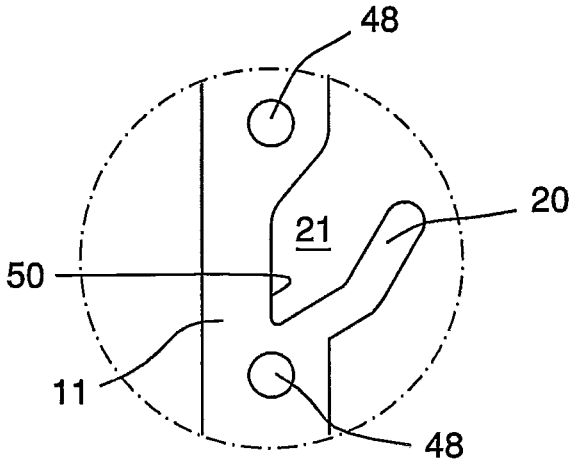

FIG. 3 shows a cross-sectional view of the output end of a rotating mill in an alternative design with curved limiting walls or carriers arranged between the pulp-lifting chambers of the output arrangement, that have the nature of a sector of a circle, FIG. 4 shows a partial perspective view of a part having the form of a sector of a circle of a central piece that is a component of the arrangement, with part an output cone that is a component of this, FIG. 5 shows a cross-sectional view of the output end of a rotating mill with capture arms designed in an alternative linear or angled straight design, and FIG. 6 shows an enlarged side view of a material collection pocket in an alternative design.

With reference to FIG. 1, parts of the output end of a drum mill intended for autogenous or semi-autogenous milling with a principally cylindrical compartment generally known as the "mill chamber" 1 is shown. The transverse and axial directions of the mill are denoted by 7' and 7, respectively. The output end wall and the jacket at the said output end are denoted by 2 and 3, respectively, whereby the said jacket is shown only partially suggested for reasons of clarity. The mill jacket is internally lined with a lining 4 of some wear-resistant material, for example an elastomer, and with appropriately designed essentially axially directed carriers 5 known as "lifters" for the efficient milling of the mineral material in the mill chamber 1, which carriers may also suitably comprise some elastomer. Also the mill end wall 2 and other parts that come into contact with mineral material that is undergoing milling or with milled material are provided with a lining of wear-resistant material. The term "wear-resistant material" will be used in the following to denote material that is used within the technological field for its resistance to wear, in which it can be a case of a material with a high degree of hardness such as hard metal, ceramic material or a material with a high damping ability, or it can be a case of material manufactured as combinations of these. A hollow material output tap 6 extends from the output end wall 2 of the mill, by which the mill is supported to allow rotation around the said essentially horizontal axis 7 by means of bearings 8 mounted in a bearing block 9, i.e. in this case a mill supported in bearings in a tap. The opposite input end of the mill for the input of crushed ore is not shown, for reasons of simplicity, but it should be understood that this end is supported in bearings in a manner that allows rotation in a manner similar to the output end described here. Suitable driving means for the rotary driving of the mill are also arranged at the mill (not shown in the drawings).

From the lining 10 of the end wall 2, which lining consists of a number of plates having the form of a sector of a circle and set essentially obliquely when viewed in the axial direction of the mill, there protrude radially set first and second limiting walls 11, 11' that are directed axially and that support at their edges, which are turned inwards towards the mill, flange sections 12, which in turn support a sieving wall 13 that consists of elements that are sectors of a circle and that are set essentially obliquely. The wall 13 is provided with a number of radially set carriers 14 and limits together with the said first and second radial limiting walls 11, 11' the lining 10, and a wall section 4', which has the form of an arc of a circle, of the inner surface 4 of the mill cover, a number of compartments 15, 15' having the form of a sector, each one of which forms what is known as a "pulp-lifting chamber" (see also FIGS. 2*a* and 2*b*). The said wall section 4' having the form of an arc of a circle thus forms the radially outermost limiting wall of the pulp-lifting chamber 15, the peripheral inner surface of this wall being turned inwards, towards the central axis 7.

Each compartment 15 having the form of a sector includes a principal part that is essentially plane and that, formed by flange sections 12 and the sieving wall 13, is, when viewed in a condition in which it is mounted in the mill, essentially vertical, and a forward cone-formed part 16 that protrudes a certain distance from the principal part into the material output tap 6 and is terminated in an outlet 17. The sieving wall 13 is provided over a major part of its extent with openings 18 that join the said sector-formed compartments 15 with the milling compartment 1 of the mill and serve for the continuous leading out of relatively finely ground mineral material from the milling compartment 1 when a pulp-lifting chamber is located at a lower part of the revolution, and, through the said sector-shaped compartment 15 that serves as a pulplifter finally out through the material output cone 16 and the central output tap of the mill when the pulp-lifting chamber is located at an upper part of the revolution.

With reference to FIGS. 2*a* and 2*b*, a cross-sectional view is shown of a part of a pulp-lifter arrangement that rotates at a constant rate of rotation in a direction of rotation denoted by the arrow 23. Starting at a lower position in a revolution, considering one of a series of pulp-lifting chambers 15 that rotate around the revolution, the rotation in an upwards part of the revolution is denoted by V and that in a downward part of the revolution is denoted by V'.

As a closer examination of FIGS. 2*a* and 2*b* will reveal, the radially set first and second limiting walls 11 and 11' have been given configurations of differing radial lengths. In the embodiment illustrated, for example, only every third wall radially limiting wall 11 around the revolution has been given full length, i.e. such a length that it extends continuously from the inner lining 4 of the drum wall 3, i.e. from the inner periphery of the wall section 4', to the material output tap 6 at the centre of the mill. It is proved to be the case that a wall configuration with limiting walls 11, 11' of differing radial lengths contributes to achieving a more highly controlled discharge of material from the relevant sector compartment 15, 15' to the material output cone 16 in the central output tap of the mill. The reference number 15 will be used below to denote a sector compartment that is limited between two neighbouring long first limiting walls 11, and the reference number 15' will be used to denote such sector compartments as are limited between such, for example a sector compartment between a first long and a second short limiting wall 11, 11', or between two neighbouring short second limiting walls 11', 11'.

FIGS. 2*a* and 2*b* make further clear that one long first limiting wall 11 at each pulp-lifting chamber 15 is equipped on its one side that is facing towards an adjacent short second limiting wall 11' with a hook-formed first capture arm 20 intended to capture mineral material (see also the enlargement of detail shown at FIG. 2*a*). Together with the lining 10 of the end wall 2 and the sieving wall 13, the capture arm 20 limits a material collection pocket 21 with an opening 22 formed by the gap of the capture arm and facing in towards the central axis 7. The said first capture arm 20 is located on that side of the limiting wall 11 that faces backwards with respect to the normal direction of rotation V of the mill, denoted by 23 in the drawings. The first capture arm 20 is located a certain distance radially inwards along the limiting wall 11, i.e. a certain distance radially inwards along the limiting wall in the direction towards the rotation axis 7. The first capture arm 20 originates as a branch at a section of wall from the long first limiting wall 11. The capture arm 20 is designed to accept and collect through the opening 22 that part of the mineral material that, after the pulplifter has passed the uppermost part of the revolution, has not had sufficient time to leave the sector-formed compartment of the pulplifter but, as the pulplifter continues to move towards the lower part of the revolution, is driven under the influence of gravity forces that arise in the return direction against the peripheral inner surface of the radially located outermost limiting wall 4' of the pulplifter 15.

Due to the fact that the capture arm 20 is located a certain distance radially inwards along the limiting wall 11, i.e. closer to the central axis 7, at least a portion of the mineral material that has not had sufficient time to leave the pulp-lifting chamber 15, but has been driven back towards the limiting wall 4' of the pulp-lifting chamber 15, which limiting wall has the form of an arc of a circle, is located farthest out and is turned to face in towards the rotation axis 7, will be captured by the arm 20 before it reaches the said limiting wall 4' or the "bottom". In the design described here, the first capture arm 20 is constituted by a first hook-shaped wall part 24' that, protruding perpendicularly from the limiting wall 11, is terminated a certain distance out by a perpendicular second wall part 24" that extends principally parallel to the limiting wall 11 or at somewhat of an angle in towards this wall.

Referring to FIGS. 1 and 4, a second capture arm 30 is arranged at each pulp-lifting chamber in a similar manner. This second capture arm 30 is formed on the side of the end wall 2 of the mill that is turned to face in towards the mill chamber 1, in close association with the material output cone 6. It should be understood that the said second capture arm 30 is located radially somewhat closer to the material output cone 6 than the first capture arm 20 described above is located.

As FIG. 4 makes most clear, the second capture arm 30 arranged at each pulp-lifting chamber 15 is formed by a wall section 31 whose extension in the sideways direction, i.e. in the transverse direction 7' of the mill, is limited by the converging ends of two neighbouring long first limiting walls 11. The second capture arm 30 limits a material collection pocket 35 together with the said first limiting walls 11, which pocket has an opening 36 that is turned radially inwards towards the central axis 7 and, as is made most clear by FIG. 1, also towards the concave inner surface 16 of the material output cone 16. It should be understood that the second capture arm 30 is located radially above the first capture arm 20, i.e. the second capture arm 30 is located a certain distance further in and closer to the central axis 7 than the first capture arm 20 is located. In a similar manner to that described above, also the second capture arm 30 will collect mineral material that does not have sufficient time to leave a pulp-lifting chamber 15 when it is located during emptying at the upper part of the revolution. As a result of this, material that is collected in the said capture arms 20, 30 will, by a process known as "progressive collection" be located closer to the output cone 16 during a subsequent revolution, and thus easier to have sufficient time to leave the pulp-lifting chamber 15. It should be realised that, due to the first and second capture arms 20, 30 being located radially above each other (one of them above the other) in each pulp-lifting chamber 15, which has the form of a sector of a circle, mineral material that has not had sufficient time to leave the pulp-lifting chamber when it is at the upper part of the revolution will, in stages of an increasing order of progressive collection, be collected by the capture arms and carried in a radial direction closer to the central axis 7, whereby the material has a greater opportunity to have sufficient time to leave the pulp-lifting chamber during a subsequent revolution. Due to this successive collection of milled mineral material in the capture arms 20, 30 of the output arrangement, the rate of revolution of the mill can be increased and run at speeds that lie more closely to the critical speeds.

In the embodiment of the invention described here, the said first capture arm 20 is formed as an intimately integrated part of a long first limiting wall 11, while the second capture arm 30 is formed as an intimately integrated part of the lining 10 of the end wall 2, which lining is manufactured from a wear-resistant material.

FIG. 3 shows a cross-sectional view of the output end of a rotating mill in an alternative design with curved radially set first limiting walls 11 that limit between them the pulp-lifting chambers 15 of the output arrangement and that have the nature of a sector of a circle. In a manner similar to that described above, also second limiting walls 11' that are curved and relatively shorter are arranged between two first limiting walls 11 that follow one after the other in the revolution. A first hook-formed capture arm 20 is formed on the side of a first limiting wall 11 that faces backwards with respect to the normal direction of rotation V of the mill, denoted by 23. The limiting walls 11 have been given by the curvature a defined sideways directed convex and a concave wall surface, whereby the concave wall surface is intended to move turned forwards in the direction of rotation. Among the advantages of this design is that the mineral material starts to leave earlier and in a more even manner during the revolution, and that the material leaves the pulplifter during a larger portion of the revolution when it is at its upper position, i.e. in the quadrants labelled II and III.

FIG. 5 shows a cross-sectional view of the output end of a rotating mill in an alternative design with radially set first limiting walls 11 that limit between them the pulp-lifting chambers 15 of the output arrangement, which chambers have the nature of a sector of a circle. In contrast to what as been described above, the first hook-formed wall portion 24' of the capture arm 20 does not protrude perpendicularly from the limiting wall 11, but protrudes instead at an oblique angle out from it, and is terminated at a second wall portion 24" extending essentially parallel with the limiting wall 11 or at somewhat of an angle in towards this. The material collection pocket 40 that is in this way limited demonstrates a form that becomes more narrow in the radial direction outwards towards the limiting wall 4' of the pulp-lifting chamber 15 that lies radially farthest out. The angle for the angle of the first limiting wall 24' of the capture arm 20 with the base is denoted by A and is preferably between 115° and 155°, and in any case so selected that the outer surface of the capture arm 20 at the wall portion forms an oblique plane that slopes inwards in towards the rotation axis 7 of the mill. The purpose of the said sloping plane is to facilitate the passage of any mineral material present across the capture arms 20 during emptying of the pulp-lifting chamber 15.

As has been mentioned above, the present arrangement may be manufactured as a construction in one single piece or it may be formed from a number of joined subcomponents of parts of a circle having the form of sectors. A number of advantages are obtained from the latter construction with a pulplifter formed from a number of joined subsegments.

With reference to FIG. 6, there is shown a part of a material collection pocket 21 formed in a radially set carrier 11 that in turn forms a part of a subsegment of a complete disc-shaped pulplifter formed as jointed subcomponents. Bolt holes 48 allow each subsegment to be joined to the output end wall 2 in a manner that allows it to be removed, and thus also to be exchanged. A capture arm 20 and a material collection pocket 21 that is limited by this are arranged in the material-transporting radially extended limiting wall 11, which pocket, as should be made clear by careful study of the drawing, also includes an indentation 50 that extends a certain distance into the limiting wall. Due to the fact that the material collection pocket 21 constitutes a part of the limiting wall 11 or the lifting blade, i.e. the material collection pocket is limited by the bottom of the indentation and the rapture arm 20, the capture arm 20 as such can be given a more discrete design in which it extends only a limited distance in the sideways direction out from the limiting wall 11, even though the material collection pocket still demonstrates a very high capacity for collecting material.

With reference to FIGS. 2*a* and 2*b*, the arrangement for the output of mineral material from a rotating drum mill described above functions in the following manner, whereby the pulplifter with the nature of a wheel has for reasons of clarity been divided into four quadrants denoted I, II, III and IV, and whereby an upwardly mobile part of the revolution is denoted by V and a downwardly mobile part of the revolution by V'.

Ore material for which the milling is complete is led in the form of a slurry to pass the openings 18 of the sieving wall 13, into and to fill a pulp-lifting chamber 15 that is, as shown in FIG. 2*a*, at the lowest point of the revolution and in the region between the first quadrant I and the last quadrant IV. When the pulp-lifting chamber 15 moves upwards during the upwardly mobile part V of a revolution, denoted by the quadrant I and at the entry into quadrant II, the material is driven under the influence of centrifugal force out towards the outer periphery of the pulp-lifting chamber 15, i.e. towards the inner surface of the wall section 4' that has the form of an arc of a circle. When the pulp-lifting chamber 15 approaches the upper part of the revolution, the mineral material starts to fall down under the influence of gravity towards the material output tap 6. Depending on the rate of rotation selected and the influence thereby of the centrifugal force, however, a part of the mineral material does not have sufficient time to leave the pulp-lifting chamber 15, and is instead driven back out towards the outermost periphery of the pulp-lifting chamber during the downwardly mobile part of the revolution, denoted by V', and at the entry into quadrant III. As a close study of the third quadrant III and the fourth quadrant IV in FIGS. 2*a* and 2*b* will make clear, a significant part of the material that has not had time during the emptying process to leave the relevant pulp-lifting chamber 15 will be collected in the pocket 21 that is limited by the first capture arm 20. This collected mineral material will come to be located through progressive collection radially closer to the central axis 7 and the material output cone 6. As a consequence of this, the mineral material has a considerably higher possibility during the emptying process of having sufficient time to leave the pulp-lifting chamber 15 during a subsequent revolution. The reason for this is partly that the collected mineral material is located more closely to the material output tap 6, and partly that it is influenced to a lesser extent by the centrifugal force by being located radially closer to the central axis 7. With reference to the third quadrant III and the fourth quadrant IV, it should be understood that since the first capture arms 20 and the second capture arms 30 are located radially one above the other in each pulp-lifting chamber 15 that has the form of a sector of a circle and in this part essentially above also the limiting wall 4' of the pulp-lifting chamber 15 that is located radially at the farthest extent, or the "bottom", the ability of the pulp-lifting chamber 15 to collect with an unreduced degree of filling new mineral-containing slurry when it is located at the bottom of the revolution, i.e. in the region between the fourth quadrant IV and the first quadrant I, is not affected.

It should be understood that it would be possible to design the first capture arms 20 and the second capture arms 30 described above in a manner such that they form an integrated part of an exchangeable lining of wear-resistant material designed to be affixed in a pulp-lifting chamber as a prefabricated unit.

The invention is not limited to what has been described above and shown in the drawings: it can be changed and modified in several different ways within the scope of the innovative concept defined by the attached patent claims.

The invention claimed is:

1. An arrangement for the output of mineral material from drum mills that can be rotated around a principally horizontal rotation axis and of the type that has a sieving wall arranged inside the drum at its output end or end wall, at which milled mineral material can leave through the sieving wall through sieving openings distributed over a major part of its extent in order to be led in to a number of pulp-lifting chambers distributed around the rotation axis, limited by the sieving wall, the said end wall, a limiting wall turned in to face the rotation axis, and limiting walls that are set radially relative to the rotation axis and that transport material, which limiting walls lead towards a central material output cone by sides that converge towards each other, whereby mineral material that is taken into the pulp-lifting chamber during a lower part of a revolution is emptied down towards the material output cone when the pulp-lifting chamber is located at an upper part of a revolution, characterized in that the pulp-lifting chamber comprises a first capture arm that extends from the radially set limiting wall of the pulp-lifting chamber to define and limit a material collection pocket with an opening that faces in towards the rotation axis and a second capture arm that is arranged at the pulp-lifting chamber at a radially different distance from the rotation axis of the mill compared to the first capture arm, whereby the material collection pocket is located at a level that lies radially closer to the rotation axis than the limiting wall of the pulp-lifting chamber that is located at the farthest radial extent and so designed that mineral material that has not had sufficient time to reach the material output cone during the emptying process of the pulp-lifting chamber but returns into the output arrangement is collected in the material collection pocket during the lower part of the revolution in order to leave the pocket during a subsequent revolution.

2. The arrangement according to claim 1, comprising an indentation that is arranged in the limiting wall extending a certain distance into the limiting wall, which indentation, in combination with the capture arm, limits the material collection pocket.

3. The arrangement according to claim 1, whereby a gap directed in towards the rotation axis is limited between the capture arm and the limiting wall.

4. The arrangement according to claim 1, whereby the first capture arm is arranged on that side of the limiting wall that faces backwards with respect to the normal direction of rotation of the mill.

5. The arrangement according to claim 1, whereby the first and second capture arms are each manufactured from a wear-resistant material.

6. The arrangement according to claim 1, whereby the first capture arm is manufactured as an integrated part of a subsegment or unit, which subsegment is intended to be fixed at the end wall of the mill in a manner that allows it to be exchanged in order to, together with a number of corresponding subsegments, form the pulp-lifting chamber of the arrangement.

7. The arrangement according to claim 1, wherein the first capture arm is a hook-formed capture arm formed of a first and a second portion of wall.

8. The arrangement according to claim 7, whereby the first wall portion of the first capture arm is assigned a gradient angle that has been selected such that a sloping plane or ramp is formed, over which mineral material can pass during the emptying of the pulp-lifting chamber.

9. The arrangement according to claim 1, comprising a collection arrangement with first and second radially set limiting walls that are curved with a defined convex and concave wall surface, in which the concave wall surface is intended to move facing forwards in the direction of rotation.

10. An arrangement for the output of mineral material from drum mills that can be rotated around a principally horizontal rotation axis and of the type that has a sieving wall arranged inside the drum at its output end or end wall, at which milled mineral material can leave through the sieving wall through sieving openings distributed over a major part of its extent in order to be led in to a number of pulp-lifting chambers distributed around the rotation axis, limited by the sieving wall, the said end wall, a limiting wall turned in to face the rotation axis, and limiting walls that are set radially relative to the rotation axis and that transport material, which limiting walls lead towards a central material output cone by sides that converge towards each other, whereby mineral material that is taken into the pulp-lifting chamber during a lower part of a revolution is emptied down towards the material output cone when the pulp-lifting chamber is located at an upper part of a revolution, characterized in that the pulp-lifting chamber comprises a material collection pocket with an opening that faces in towards the rotation axis; and a collection arrangement with first and second radially set limiting walls with mutually differing radial lengths, and that are so arranged that one or several limiting walls that are relatively shorter are located between limiting walls of the relatively longer type, whereby the material collection pocket is located at a level that lies radially closer to the rotation axis than the limiting wall of the pulp-lifting chamber that is located at the farthest radial extent and so designed that mineral material that has not had sufficient time to reach the material output cone during the emptying process of the pulp-lifting chamber but returns into the output arrangement is collected in the material collection pocket during the lower part of the revolution in order to leave the pocket during a subsequent revolution.

11. An arrangement for use within a drum mill for removing material from the interior of the drum mill through a material output cone defined by an end wall of the drum mill by rotation about a principally horizontal rotation axis, the arrangement comprising:

a sieving wall arranged inside the drum mill at an output end of the drum mill, the sieving wall having a plurality of sieving openings distributed over a radially outward portion of the sieving wall;

a plurality of pulp-lifting chambers distributed around the rotation axis, wherein each of the pulp-lifting chambers is limited by the sieving wall, the end wall, a radial outer wall that faces the rotation axis and a limiting wall extending radially toward the rotation axis, wherein the limiting walls lead toward the output cone of the drum mill, wherein mineral material that is taken into the pulp-lifting chamber during a lower part of a revolution is emptied down towards the material output cone when the pulp-lifting chamber is located at an upper part of a revolution;

a first capture arm that extends from the limiting wall of each pulp-lifting chamber to define a first material collection pocket with an opening that faces toward the horizontal rotation axis; and a second capture arm that is arranged in each pulp-lifting chamber at a radially different distance from the rotation axis of the mill compared to the first capture arm, wherein the second capture arm defines a second material collection pocket, wherein the first material collection pocket and the second material collect pockets are both located radially closer to the rotation axis than the radial outer wall of the pulp-lifting chamber so that mineral material that has not had sufficient time to reach the material output cone during the emptying process of the pulp-lifting chamber is collected in either the first material collection pocket or the second material collection pocket.

* * * * *